US009222478B2

(12) United States Patent
Chang et al.

(10) Patent No.: US 9,222,478 B2
(45) Date of Patent: Dec. 29, 2015

(54) BLADELESS FAN STRUCTURE

(75) Inventors: Bor-Haw Chang, New Taipei (TW); Shih-Chieh Lin, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 952 days.

(21) Appl. No.: 13/402,386

(22) Filed: Feb. 22, 2012

(65) Prior Publication Data

US 2013/0216404 A1 Aug. 22, 2013

(51) Int. Cl.
*F04D 23/00* (2006.01)
*F04D 29/057* (2006.01)

(52) U.S. Cl.
CPC ..... *F04D 23/00* (2013.01); *F04D 23/006* (2013.01); *F04D 29/057* (2013.01)

(58) Field of Classification Search
CPC ..... F04D 29/057; F04D 23/006; F04D 23/00; F04D 13/02
USPC ..... 417/321; 415/90, 91, 92, 71, 73, 72, 415/206
See application file for complete search history.

(56) References Cited

U.S. PATENT DOCUMENTS 1,448,080 A * 3/1923 Noeggerath ..... 416/176
1,665,931 A * 4/1928 Noeggerath ..... 415/72
2,284,948 A * 6/1942 Combs ..... 415/175
2,433,795 A * 12/1947 Stokes ..... 416/91
3,109,948 A * 11/1963 Hellmann ..... 310/68 R
3,669,517 A * 6/1972 Hughes ..... 384/115
4,648,819 A * 3/1987 Sakamaki et al. ..... 418/173
4,925,321 A * 5/1990 Maruyama et al. ..... 384/114
7,118,353 B2 * 10/2006 Maruyama et al. ..... 417/313
2002/0044867 A1 * 4/2002 Gharib ..... 415/90
2002/0119040 A1 * 8/2002 Bosley ..... 415/72
2010/0021324 A1 * 1/2010 Conrad ..... 417/423.12
2010/0269826 A1 * 10/2010 Colombo et al. ..... 128/203.26

* cited by examiner

*Primary Examiner* — Dwayne J White
*Assistant Examiner* — Joshua R Beebe
(74) *Attorney, Agent, or Firm* — C. G. Mersereau; Nikolai & Mersereau, P.A.

(57) ABSTRACT

A bladeless fan structure includes a driving member, a pipe member, and at least one air-pressure increasing area. The driving member has a shaft connected and extended through the pipe member, and a first space is formed between an inner surface of the pipe member and an outer surface of the shaft. The air-pressure area is provided on the inner surface of the pipe member or the outer surface of the shaft. The pipe member is provided with at least one opening communicating with the first space and the air-pressure increasing area. When the driving member drives the shaft to rotate in and relative to the pipe member, air in the first space is brought to flow and is compressed in a direction along the air-pressure increasing area to blow out of the pipe member via the opening to achieve the function of a bladeless fan.

6 Claims, 6 Drawing Sheets

BLADELESS FAN STRUCTURE

FIELD OF THE INVENTION

The present invention relates to a bladeless fan structure, and more particularly to a bladeless fan structure that has largely reduced volume and enables reduced noise and vibration during operation thereof.

BACKGROUND OF THE INVENTION

With the quick development in the electronic industrial fields, the density of transistors in various kinds of chips, such as a central processing unit (CPU), also increases constantly. While these chips with high density of transistors can process data at highly increased speed, they also consume higher power and produce more heat during the operation thereof. For these chips, such as the CPU, to operate stably all the time, it is necessary to remove the produced heat with high-efficiency heat dissipating devices, including but not limited to a fan.

A conventional fan structure for dissipating heat includes a frame, a stator assembly, and a rotor. The rotor includes a hub and a plurality of blades radially outward extended from the hub. When the fan operates, the blades rotate to bring surrounding air to flow and produce air flows. When the fan rotates at high speed, the blades are buffeted by air to produce annoying noise and vibration. Moreover, with the rotor having a hub and a plurality of blades, the conventional fan structure is bulky and heavy and can not be easily miniaturized.

In brief, the conventional fan structure has the following disadvantages: (1) having a big volume; and (2) tending to produce noise and vibration during operation.

It is therefore tried by the inventor to develop an improved bladeless fan structure to overcome the problems in the conventional fan structure.

SUMMARY OF THE INVENTION

A primary object of the present invention is to provide a bladeless fan structure that has largely reduced volume and enables reduced noise and vibration during operation thereof.

To achieve the above and other objects, the bladeless fan structure according to the present invention includes a driving member, a pipe member, and at least one air-pressure increasing area. The driving member has a shaft axially extended through the pipe member, so that a first space is formed between an inner surface of the pipe member and an outer surface of the shaft. The pipe member is provided with at least one opening communicating with the first space. The air-pressure increasing area is selectively provided on one of the inner surface of the pipe member and the outer surface of the shaft and communicates with the opening on the pipe member.

When the driving member drives the shaft to rotate in the pipe member, air in the first space flows and is compressed in a direction along the air-pressure increasing area to finally blow out of the pipe member via the opening. With the above arrangements, the bladeless fan structure of the present invention has largely reduced volume and enables reduced noise and vibration during operation thereof.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
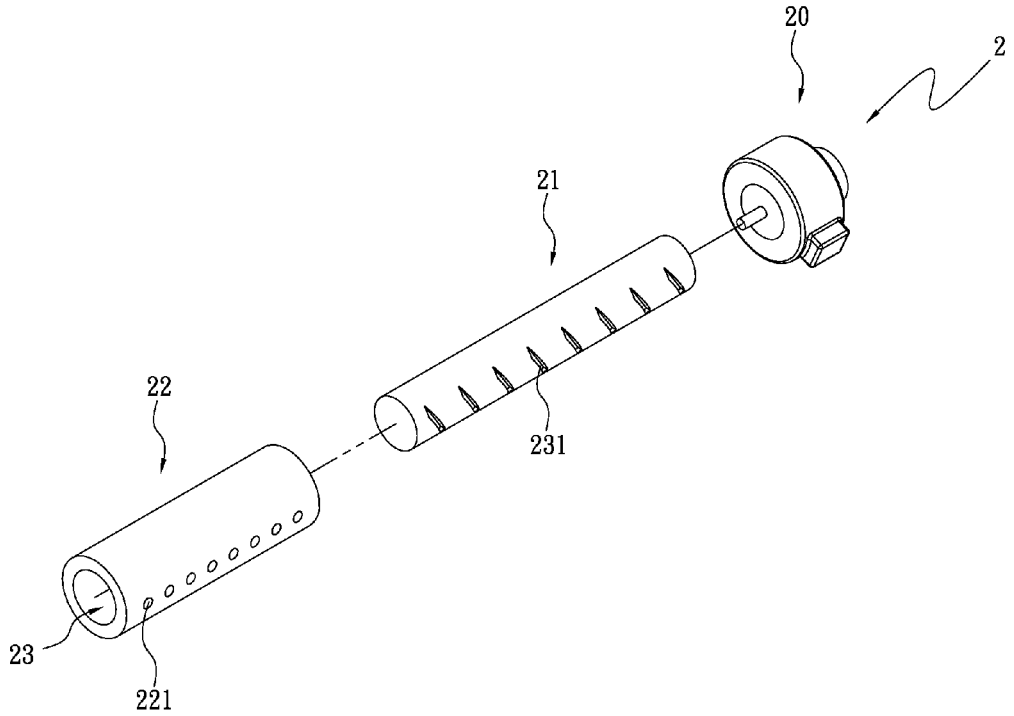
FIG. 1A is an exploded perspective view of a bladeless fan structure according to a first embodiment of the present invention.

The present invention will now be described with some preferred embodiments thereof and with reference to the accompanying drawings. For the purpose of easy to understand, elements that are the same in the preferred embodiments are denoted by the same reference numerals.

Figure 1B:
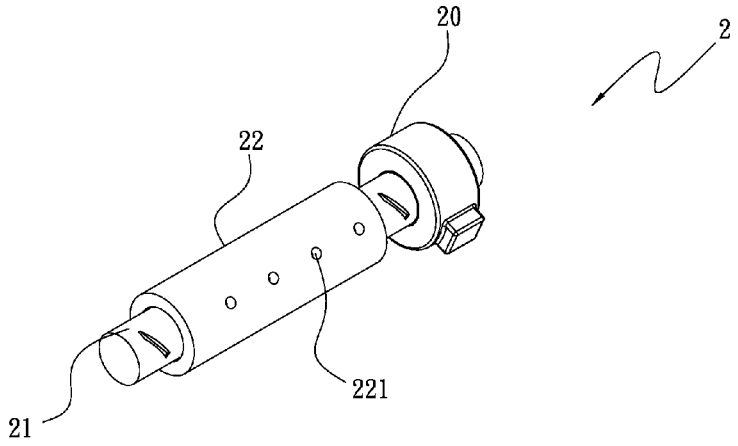
FIG. 1B is an assembled view of FIG. 1A.

Please refer to FIGS. 1A and 1B that are exploded and assembled perspective views, respectively, of bladeless fan structure 2 according to a first embodiment of the present invention. As shown, the bladeless fan structure 2 includes a driving member 20, a pipe member 22 and at least one air-pressure increasing area 231. A shaft 21 is connected to and driven by the driving member 20 to rotate.

The shaft 21 is axially extended through the pipe member 22, such that a first space 23 is formed between an inner surface of the pipe member 21 and an outer surface of the shaft 21. Further, the pipe member 22 is provided with at least one opening 221 communicating with the first space 23. In the illustrated first embodiment, more than one opening 221 is provided on the pipe member 22.

As shown in FIG. 1A, the air-pressure increasing area 231 is provided on the outer surface of the shaft 21. In the illustrated first embodiment, multiple air-pressure increasing areas 231 are provided on the shaft 21, and the openings 221 on the pipe member 22 are respectively located at a position corresponding to an end of one of the air-pressure increasing areas 231. When the shaft 21 is axially extended through the pipe member 22 and driven by the driving member 20 to rotate in and relative to the pipe member 22, air in the first space 23 is brought to flow. The produced air flow is compressed in the directions along the air-pressure increasing areas 231 and forms multiple high-pressure air flows in the pipe member 22, and the high-pressure air flows finally blow out of the pipe member 22 via the openings 221. With these arrangements, the bladeless fan structure 2 can have largely reduced volume, vibration and noise.

Figure 2:
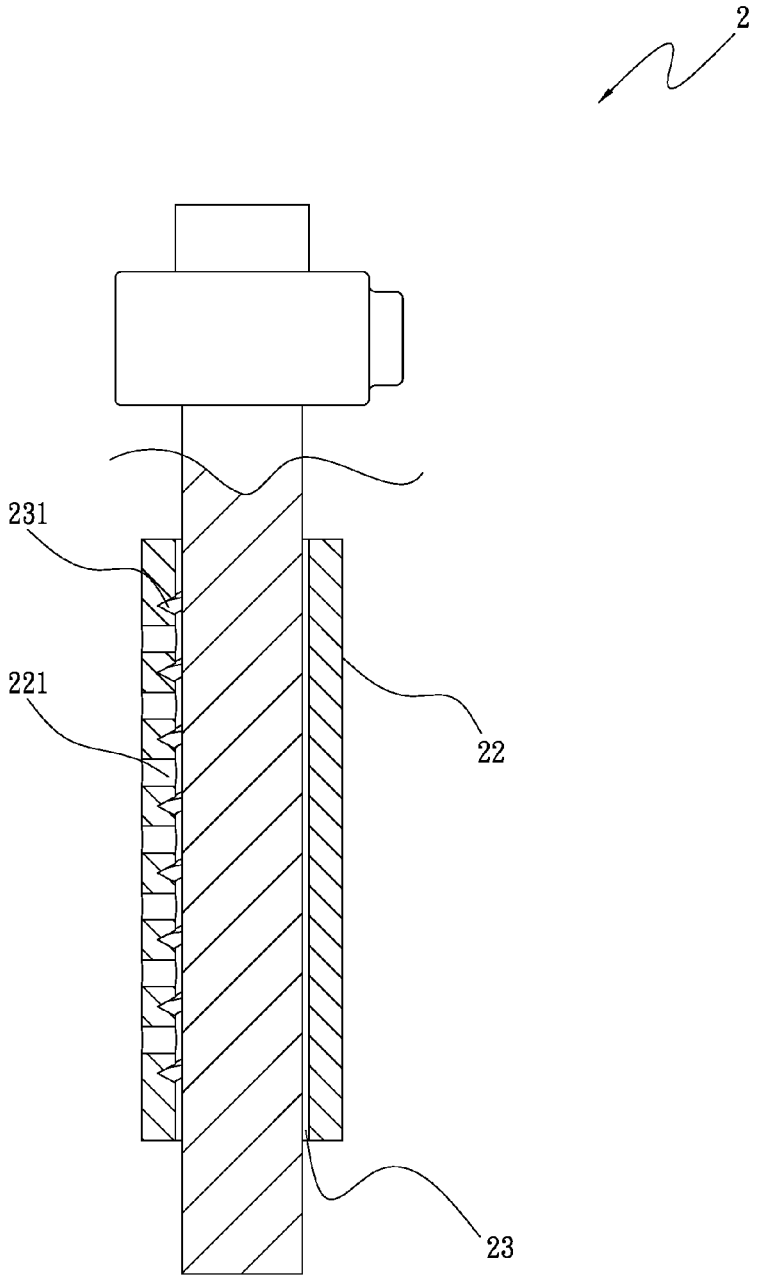
FIG. 2 is a partially sectioned side view of a bladeless fan structure according to a second embodiment of the present invention.

Please refer to FIG. 2 that is a partially sectioned side view of a bladeless fan structure 2 according to a second embodiment of the present invention. As shown, the bladeless fan structure 2 according to the second embodiment is generally structurally similar to the first embodiment, except that the air-pressure increasing areas 231 are provided on the inner surface of the pipe member 22 and the openings 221 are formed on the pipe member 22 at locations corresponding to the ends of the air-pressure increasing areas 231. By providing the air-pressure increasing areas 231 on the inner surface of the pipe member 22, air in the first space 23 is compressed in the directions along the air-pressure increasing areas 231 to form multiple high-pressure air flows that finally blow out of the pipe member 22 via the openings 221.

Figure 3:
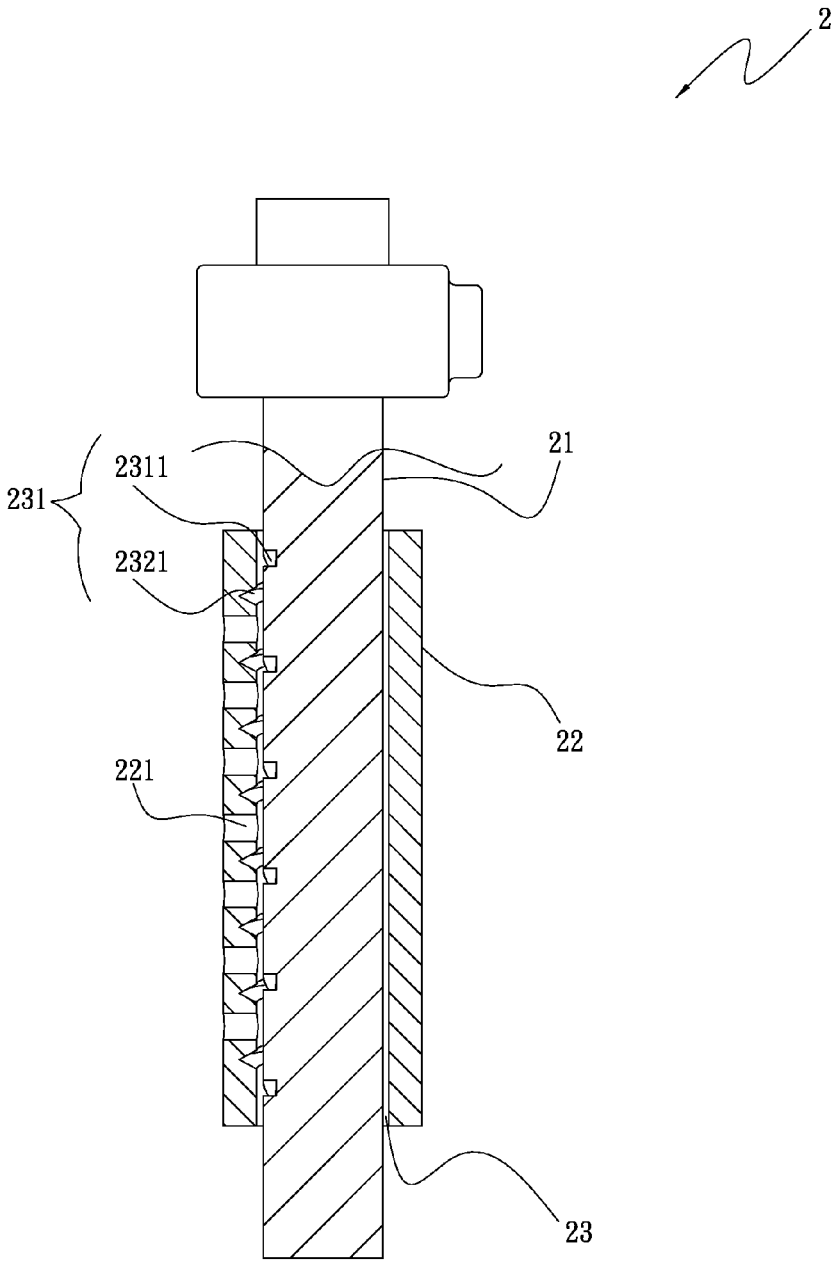
FIG. 3 is a partially sectioned side view of a bladeless fan structure according to a third embodiment of the present invention.

FIG. 3 is a partially sectioned side view of a bladeless fan structure 2 according to a third embodiment of the present invention. As shown, the bladeless fan structure 2 according to the third embodiment is generally structurally similar to the previous embodiments, except that each of the air-pressure increasing areas 231 includes a first air-pressure increasing section 2311 and a second air-pressure increasing section 2321, which are formed on the outer surface of the shaft 21 and the inner surface of the pipe member 22, respectively, and that the openings 221 are formed on the pipe member 22 at locations corresponding to the ends of the first air-pressure increasing sections 2311 and of the second air-pressure increasing sections 2321. By providing the first and the second air-pressure increasing sections 2311, 2321 on the shaft 21 and the pipe member 22, respectively, air in the first space 23 is compressed in the directions along the first and the second air-pressure increasing sections 2311, 2321 to form multiple high-pressure air flows that finally blow out of the pipe member 22 via the openings 221.

Figure 4:
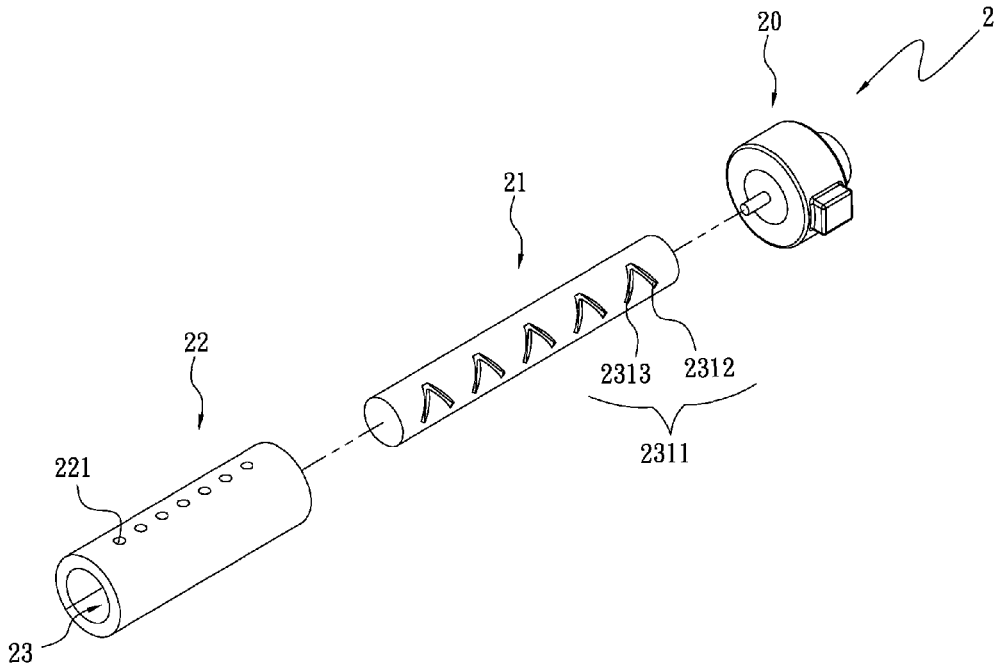
FIG. 4 is an exploded perspective view of a bladeless fan structure according to a fourth embodiment of the present invention.

Please refer to FIG. 4 that is an exploded perspective view of a bladeless fan structure 2 according to a fourth embodiment of the present invention. As shown, the bladeless fan structure 2 according to the fourth embodiment is generally structurally similar to the previous embodiments, except that each of the first air-pressure increasing sections 2311 provided on the outer surface of the shaft 21 includes a first groove 2312 and a second groove 2313, which join and communicate with each other at respective one end, and that the openings 221 are formed on the pipe member 22 at locations corresponding to the joints of the first and the second grooves 2312, 2313. When the shaft 21 is driven by the driving member 20 to rotate in and relative to the pipe member 22, air in the first space 23 is brought to flow. The produced air flow is compressed in the directions along the first and the second grooves 2312, 2313 to form multiple high-pressure air flows in the pipe member 22, and the high-pressure air flows finally blow out of the pipe member 22 via the openings 221.

Figure 5:
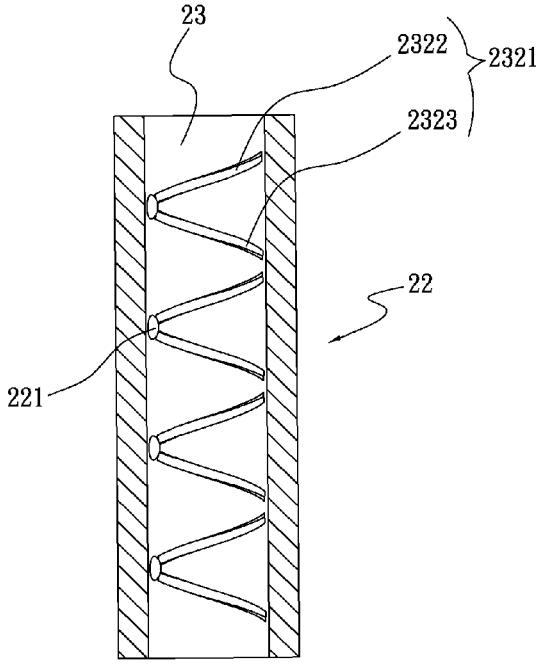
FIG. 5 is a sectional view of a pipe member of a bladeless fan structure according to a fifth embodiment of the present invention.

FIG. 5 is a sectional view of a pipe member 22 for a bladeless fan structure according to a fifth embodiment of the present invention. Please refer to FIG. 5 along with FIG. 4. As shown, the bladeless fan structure 2 according to the fourth embodiment is generally structurally similar to the previous embodiments, except that each of the second air-pressure increasing sections 2321 provided on the inner surface of the pipe member 22 includes a third groove 2322 and a fourth groove 2323, which join and communicate with each other at respective one end, and that the openings 221 are formed on the pipe member 22 at locations corresponding to the joints of the third and the fourth grooves 2322, 2323. When the shaft 21 is driven by the driving member 20 to rotate in and relative to the pipe member 22, air in the first space 23 is brought to flow. The produced air flow is compressed in the directions along the third and the fourth grooves 2322, 2323 to form multiple high-pressure air flows, and the high-pressure air flows finally blow out of the pipe member 22 via the openings 221.

Figure 6A:
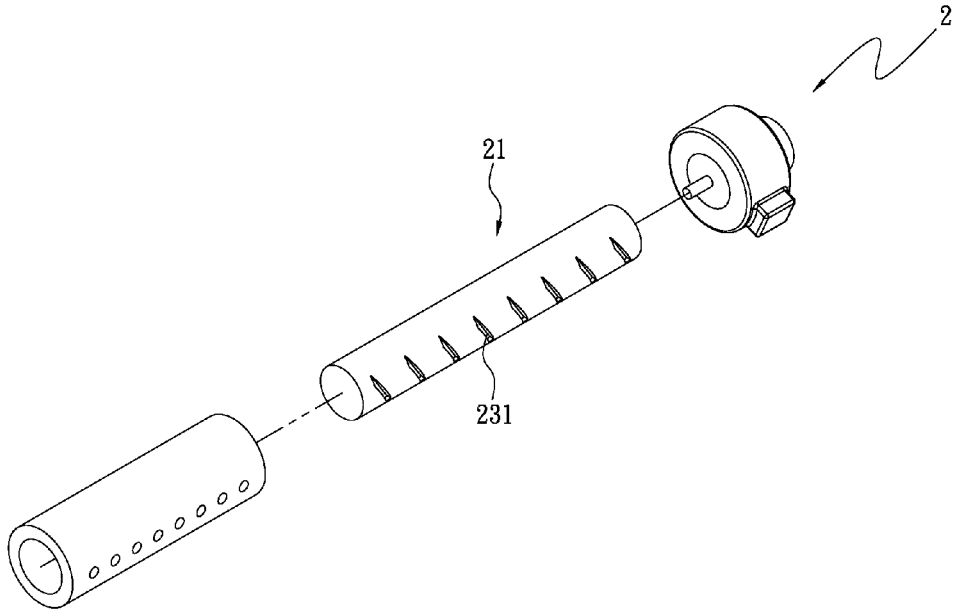
FIG. 6A is an exploded perspective view of a bladeless fan structure according to a sixth embodiment of the present invention.
Figure 6B:
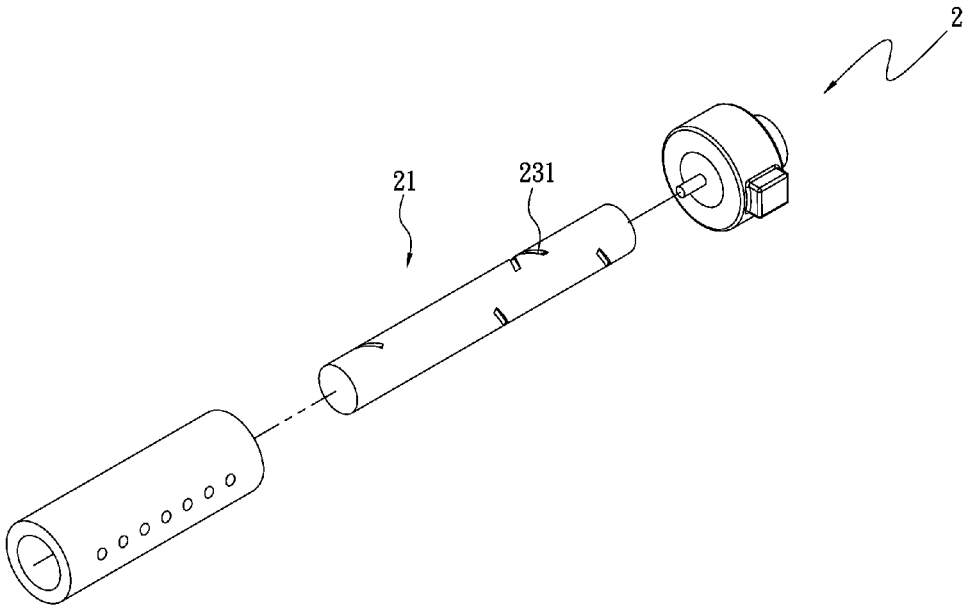
FIG. 6B is an exploded perspective view of a variant of the bladeless fan structure according to the sixth embodiment of the present invention.

FIG. 6A is an exploded perspective view of a bladeless fan structure 2 according to a sixth embodiment of the present invention. As shown, the bladeless fan structure 2 according to the sixth embodiment is generally structurally similar to the previous embodiments with the air-pressure increasing areas 231 successively arranged on the outer surface of the shaft 21. On the other hand, FIG. 6B is an exploded perspective view of a variant of the bladeless fan structure 2 according to the sixth embodiment of the present invention, in which the air-pressure increasing areas 231 are non-successively arranged on the outer surface of the shaft 21.

Figure 7A:
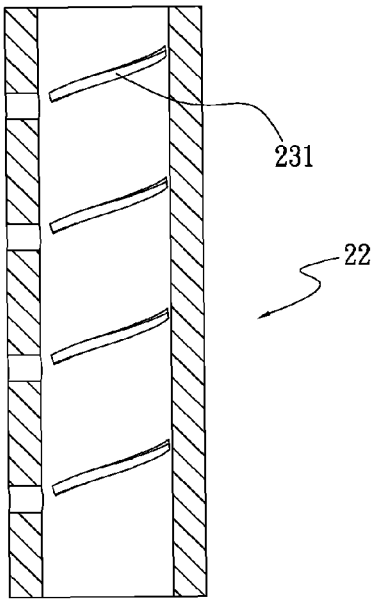
FIG. 7A is a sectional view of a pipe member of a bladeless fan structure according to a seventh embodiment of the present invention.
Figure 7B:
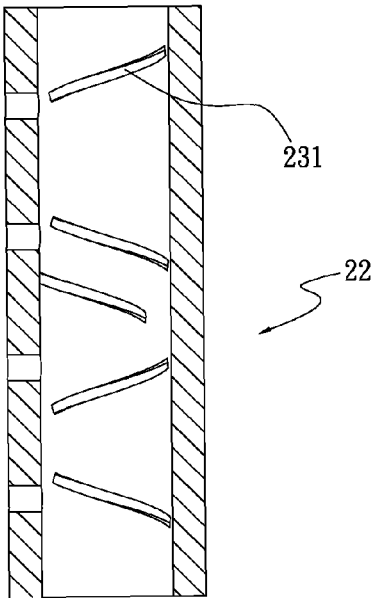
FIG. 7B is a sectional view of a variant of the pipe member of the bladeless fan structure according to the seventh embodiment of the present invention.

FIG. 7A is an exploded perspective view of a bladeless fan structure 2 according to a seventh embodiment of the present invention. As shown, the bladeless fan structure 2 according to the seventh embodiment is generally structurally similar to the previous embodiments with the air-pressure increasing areas 231 successively arranged on the inner surface of the pipe member 22. On the other hand, FIG. 7B is an exploded perspective view of a variant of the bladeless fan structure 2 according to the seventh embodiment of the present invention, in which the air-pressure increasing areas 231 are non-successively arranged on the inner surface of the pipe member 22.

In brief, the bladeless fan structure according to the present invention is superior to the conventional fans in that it has a small volume and enables reduced noise and vibration during operation thereof.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A bladeless fan structure, comprising:

a solid shaft member;

a driving member for driving the shaft connected thereto to rotate;

a pipe member, through which the shaft of the driving member being axially extended to form a first space between an inner surface of the pipe member and an outer surface of the shaft; and the pipe member being formed with a single row comprising more than one opening in the sidewall thereof to communicate with the first space; and at least one air-pressure increasing area including a first air-pressure increasing section and a second air-pressure increasing section provided on the outer surface of the shaft and the inner surface of the pipe member, respectively, and the air-pressure increasing area being communicable with the first space;

wherein when the shaft is axially extended through the pipe member and driven by the driving member to rotate, air in the first space forms air flows due to rotation of the shaft said air flows blowing out of the pipe member via the openings.

2. The bladeless fan structure as claimed in claim 1, wherein at least one of the openings formed on the pipe member is located corresponding to an end of the first air-pressure increasing section.

3. The bladeless fan structure as claimed in claim 2, wherein at least one of the openings formed on the pipe member is located corresponding to an end of the second air-pressure increasing section.

4. The bladeless fan structure as claimed in claim 2, wherein the first air-pressure section includes a first groove and a second groove, which join and communicate with each other at respective one end; and at least one of the openings formed on the pipe member being located corresponding to the joint of the first and the second groove; and wherein the second air-pressure section includes a third groove and a fourth groove, which join and communicate with each other at respective one end; and at least one of the openings formed on the pipe member being located corresponding to the joint of the third and the fourth groove.

5. The bladeless fan structure as claimed in claim 2, wherein more than one air-pressure increasing area is provided, and the first air-pressure increasing sections being successively or non-successively arranged on the outer surface of the shaft.

6. The bladeless fan structure as claimed in claim 2, wherein more than one air-pressure increasing area is provided, and the second air-pressure increasing sections being successively or non-successively arranged on the inner surface of the pipe member.

* * * * *